United States Patent [19]

Lyasko

[11] Patent Number: 4,827,969

[45] Date of Patent: May 9, 1989

[54] COVER FOR A HYDRANT

[76] Inventor: Peter Lyasko, 50 Old Middletown Rd., Rockaway, N.J. 07866

[21] Appl. No.: 251,235

[22] Filed: Sep. 30, 1988

[51] Int. Cl.[4] ..... E03B 9/06

[52] U.S. Cl. ..... 137/296; 137/377; 137/382; 137/800; 220/85 P

[58] Field of Search ..... 137/296, 377, 382, 800; 220/284, 85 P

[56] References Cited

U.S. PATENT DOCUMENTS

| | | | |
|---|---|---|---|
| 1,080,719 | 12/1913 | Rourke | 137/296 |
| 1,176,855 | 3/1916 | Rourke | 137/296 |
| 2,576,631 | 11/1951 | Mueller et al. | 137/296 |
| 3,534,941 | 10/1970 | Dunton | 137/296 |
| 4,000,753 | 1/1977 | Ellis | 137/296 |
| 4,033,372 | 7/1977 | Bowman | 137/296 |
| 4,141,574 | 2/1979 | Stansifer et al. | 137/296 |
| 4,390,038 | 6/1983 | Salvato | 137/296 |
| 4,727,900 | 3/1988 | Dooling et al. | 137/296 |

FOREIGN PATENT DOCUMENTS

| | | | |
|---|---|---|---|
| 158253 | 10/1939 | Fed. Rep. of Germany | 137/296 |
| 692547 | 3/1940 | Fed. Rep. of Germany | 137/296 |

*Primary Examiner*—George L. Walton
*Attorney, Agent, or Firm*—Thomas L. Adams

[57] ABSTRACT

A cover encompasses a hydrant having a bonnet mounted atop an upper barrel having two flanged ends. The cover has a domed annular hood shaped to correspond to the bonnet. The cover also has an externally convex skirt depending from the annular hood. This convex skirt is sized to overlay and underlie one of the flanged ends of the upper barrel to encase it. The cover may include an axially seamed, tubular jacket and positioned to meet the convex skirt from below. This jacket is sized to encompass the upper barrel of the hydrant. An optional tubular boot can encircle the barrel between one of its flanged ends and the jacket.

19 Claims, 4 Drawing Sheets

FIG. 4A
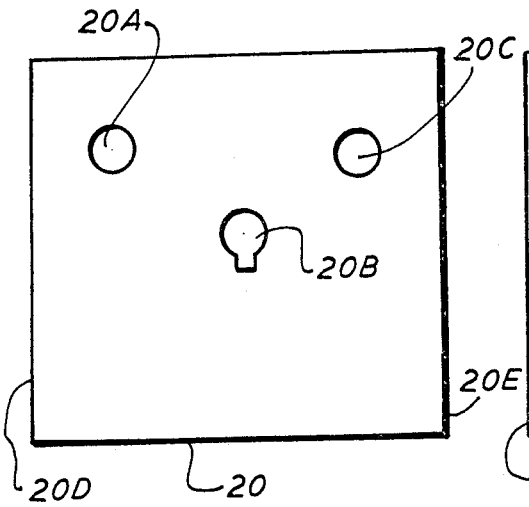
FIG. 4B
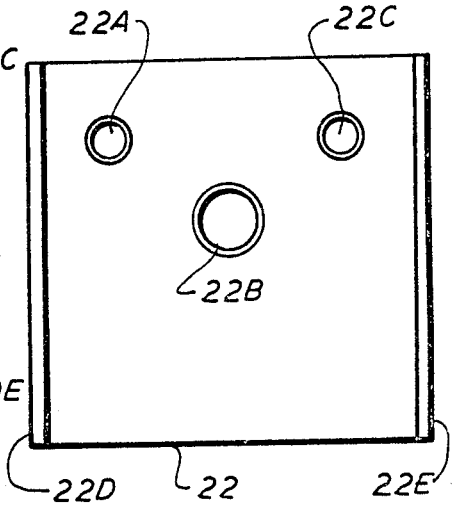
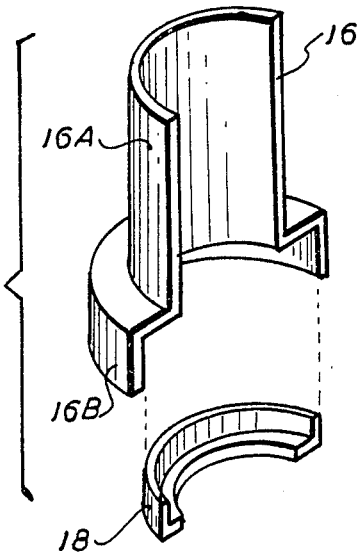
FIG. 3
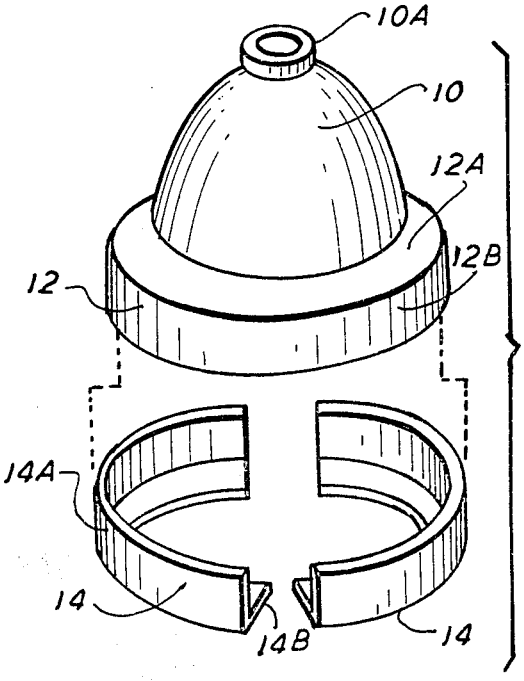
FIG. 2

FIG. 6
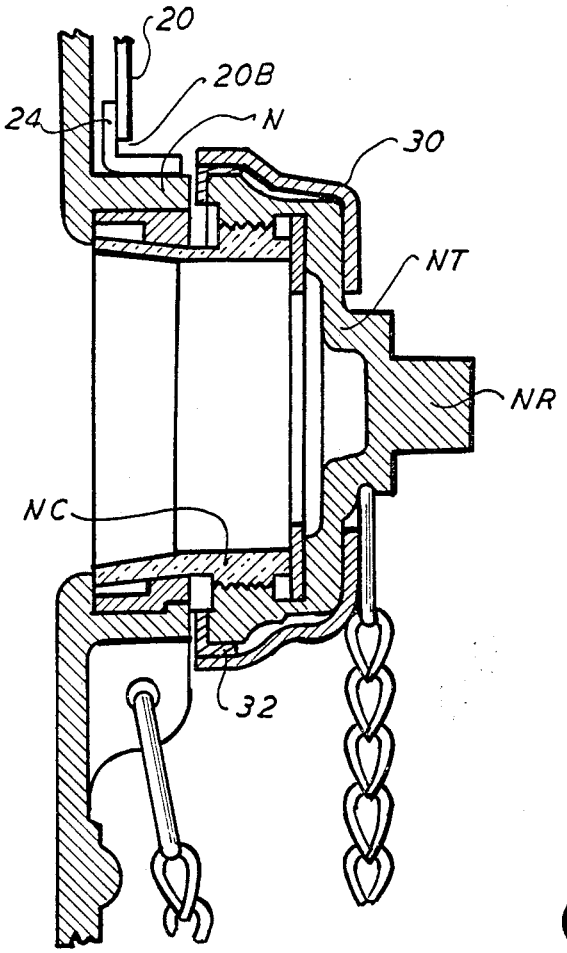
FIG. 7
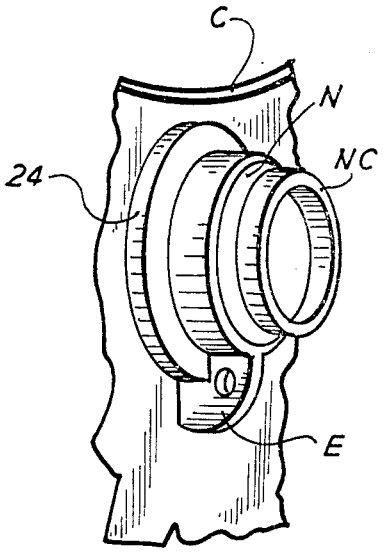
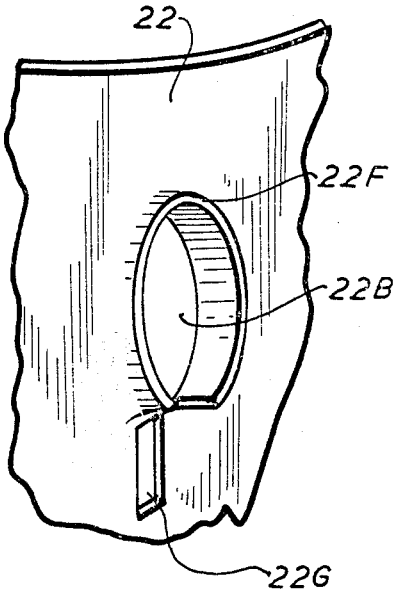
FIG. 5

COVER FOR A HYDRANT

BACKGROUND OF THE INVENTION

The present invention relates to hydrant covers and, in particular, to covers having a domed hood to cover the hydrant bonnet.

Hydrants must be painted regularly to protect them. This maintenance is time-consuming and costly. Often the paint is color coded to indicate the pressure or flow rate. Accordingly, painting is not only important for protection, but to make the hydrant visible in an emergency. Regular painting, however, builds a thick coating on nuts that may then become difficult to remove when the internal mechanism of the hydrant must be repaired.

It is known to provide a cylindrical skirt on a hydrant that may be released and dropped by a key. The skirt is designed to prevent tampering. However, this arrangement interferes with the use of the hydrant in an emergency. The structure does not closely conform to the shape of the hydrant; and therefore is an interference.

Other known hydrant covers are mostly in the form of a box, which encloses the hydrant for protection and other purposes. Again these covers interfere with the use of the hydrant and impose an additional step which must be performed before the hydrant can be used in an emergency.

Accordingly, there is a need for a efficient way of both protecting a hydrant and coloring it appropriately so that it is either visible in an emergency or color coded to indicate its capacity.

SUMMARY OF THE INVENTION

In accordance with illustrative embodiments demonstrating features and advantages of the present invention, there is provided a cover for a hydrant having a bonnet mounted atop an upper barrel having two flanged ends. The cover includes a domed annular hood shaped to correspond to the bonnet. The cover also includes an externally convex skirt depending from the annular hood. This convex skirt is sized to overlay and underlie one of the flanged ends of the upper barrel to encase it.

In accordance with an optional embodiment of the same invention, the cover further includes a tubular jacket. The tubular jacket has an axial seam and is positioned to meet the convex skirt from below. This jacket is sized to encompass the upper barrel.

Also in accordance with an optional embodiment of the same invention, the cover further includes a tubular boot. This tubular boot encircle the barrel between one of its flanged ends and the jacket.

By employing apparatus of the foregoing type, an improved hydrant cover is achieved. In the disclosed preferred embodiments, the hydrant cover can be formed of a plastic shell, which is dimensioned to closely encase the hydrant. By properly shaping and positioning the various elements of the cover, all of the hydrant features which must be accessible in an emergency, can be used without interference. In the disclosed embodiment, the cover includes a hood for the bonnet. This hood has an aperture on top, which allows access to the operating nut, for controlling the water flow. The pumper nozzle and streamer flanges have a metal cap, which covers each outlet of the hydrant. In a disclosed embodiment, the nozzle is capped and then covered by another external plastic cap, which can be secured by rearward flanges. The external cap has an aperture so that the removal nut is exposed. Thus a fireman can remove all caps from the nozzle without interference from the external covering of the present invention.

In the disclosed embodiment, the hood for the hydrant bonnet can either be unitary or a spilt structure either of which can employ a fastening flange. The spilt structure is assembled around the hydrant bonnet and secured together with pop rivets, glue etc. Alternatively, the bonnet cover can be a bell-shaped structure that is placed over the hydrant bonnet and secured in placed by a split annular clip that holds the hood in place. The clip can be likewise glued, riveted etc.

A degree of adjustability is achieved with a tubular jacket and tubular boot. Each may be fitted around the barrel of the hydrant to telescope with respect to each other. Accordingly, different barrel lengths may be accommodated. In one embodiment, the tubular jacket may be a plastic sheet that has appropriate holes for the various nozzles on the hydrant barrel. The jacket may be wrapped around the body of the barrel and secured together at a seam by gluing riveting etc. The boot may be a split structure that partially encompasses the tubular jacket. It may be horn shaped and split so that it can be readily secured around the bottom flanges of a hydrant barrel. It may also be fastened under the flanges of the barrel by a split annulus having a "L" shaped cross section.

A BRIEF DESCRIPTION OF THE DRAWINGS

The above brief description as well as other objects, features and advantages of the present invention will be more fully appreciated by reference to the following detailed description of presently preferred, but nonetheless an illustrative embodiments in accordance with the present invention when taken into conjunction with the accompanying drawings wherein:

FIG. 2 is an exploded, perspective view showing the hood and convex skirt of FIG. 1;

FIG. 3 is an exploded, perspective view of a half-shell of the boot of FIG. 1;

FIG. 4A is a development of the jacket of FIG. 1;

FIG. 4B is a development of a jacket which is an alternate to that of FIG. 4A;

FIG. 5 is a detailed perspective view of the nozzle area of the jacket of FIG. 4B, modified to have a keyhole opening;

FIG. 6 is an elevational view shown in cross section along the axis of the nozzle of a hydrant employing the cover of FIG. 1;

FIG. 7 is a detailed perspective view showing the nozzle of FIG. 6 with its nozzle cap removed;

DETAILED DESCRIPTION OF THE PREFERRED EMBODIMENTS

Figure 1:
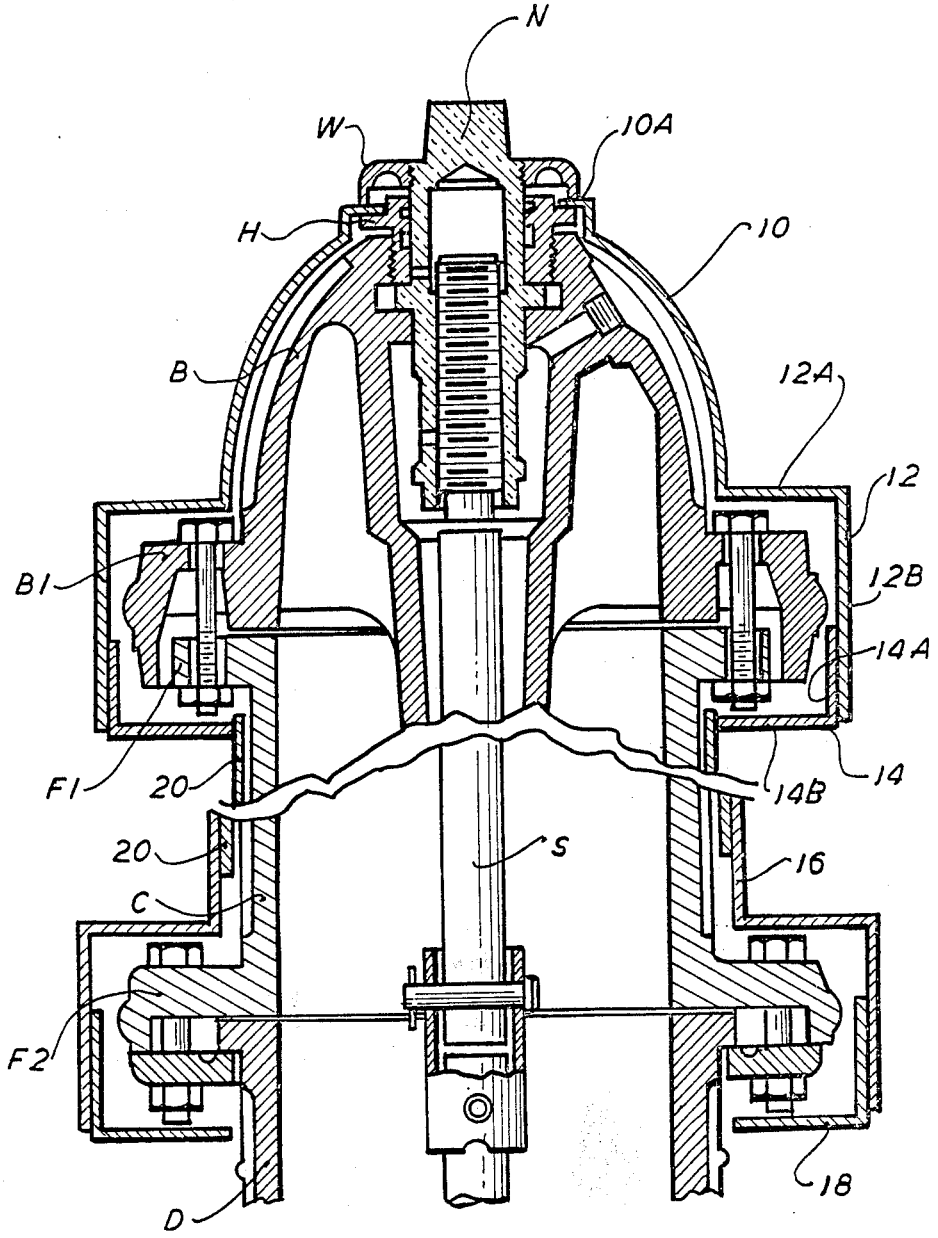
FIG. 1 is an elevational view taken in cross section along the axis of the hydrant, showing the cover of the present invention.

Referring to FIGS. 1 and 2, they show a covering including hood 10, a dome shaped shell having a skirt 12. Skirt 12 is externally convex and includes a radial ledge 12A and a semicylindrical wall 12B. The top of dome 10 has a central hole bordered by a ledge 10A.

A conventional hydrant is shown herein comprising a bonnet B bolted by means of flange Bl to the upper flange Fl of barrel C. Barrel C has lower flange F2 which bolts to lower barrel D. Bonnet B is coupled in the usual fashion, to operating nut N which is encircled by weather cap W. The operating nut N is held in place by hold down nut H, which is threaded into the top of bonnet B.

Cylindrical ledge 10A is trapped between hold down nut H and weather cap W. Shell 10A can be installed by removing weather cap W, placing hood 10 in the position shown, and replacing weather cap W.

The flange Bl and its bolts are encompassed and protected by skirt 12 and clip 14. Clip 14 is shown herein as a pair of complementary arches having anouter semicylindrical wall 14A and an annular planar base 14B. hood 10, clip 14 and skirt 12 can be formed of various materials, preferably a thermoplastic or other durable materials that can be readily dyed in bright colors and can withstand the elements.

In this embodiment, hood 10 is further secured to bonnet B by attaching clip 14 to skirt 12. Clip 14 can be secured by rivets, glue or other appropriate fastening means. Once clip 14 is attached in this fashion, flange Bl keeps hood 10 in place, even if weather cap W is not employed in this particular installation. Alternatively, clip 14 can be made integral with skirt 12. In this latter situation, hood 10 can be split along a vertical plane that includes the axis of hood 10. Accordingly, the two half-shells can be placed around bonnet B and then secured together by glue, rivets etc.

Referring to FIGS. 1 and 3, boot 16 is shown herein as a cylindrical structure having an upper cylindrical portion 16A and an a lower cylindrical portion 16B, having an increased diameter. In this embodiment, boot 16 is formed from a pair of complementary half-shells, which may be placed around the outside of the barrel C to encompass it and the lower flange F2 of barrel C. The half-shells can be secured together with rivets, glue, etc. Also in this embodiment, a pair of complementary clips 18 are secured into the bottom of boot 16 in a fashion similar to that previously described for clip 14. Clip 18 can be glued, riveted or otherwise secured to the inside surface of lower portion 16B of boot 16. Installed in this fashion, boot 16 will not tend to ride upwardly since it will be held in place by flange F2. Furthermore, the bolts around lower flange F2 will be protected by lower portions 16B and by clip 18.

Referring to FIGS. 1 and 4A, a tubular jacket is shown as a sheet formed of thermoplastic material, for example, that can be wrapped around barrel C. As shown in FIG. 4A, the jacket 20 has apertures 20A, 20B and 20C. These apertures are sized to allow nozzles to protrude beyond the outside surface of jacket 20. The jacket is shown as a development in FIG. 4A, but it will be appreciated that in some embodiments, the thickness of jacket 20 is such that it will not readily lay flat, but will be produced having a natural curve. In such embodiments the jacket can be formed of two complementary halves that can be joined together by riveting, gluing etc. The edges 20D and 20E of jacket 20 are seams that will be joined together when the jacket 20 is installed. In some embodiments, seams 20D and 20E will be overlapped and secured together by glue, rivets, etc. It will be noted that aperture 20B is keyhole shaped to allow certain structure on the barrel C to protrude beyond jacket 20.

Referring to FIG. 4B, it shows an alternate jacket 22 that has its seams as perpendicular tabs 22D and 22E. The tabs at seams 22D and 22E may be butted and secured together by rivets, glue etc. In addition, the apertures 22A, 22B and 22C in jacket 22 are similar to those previously described in connection with Fig. 4A, except that each has a sleeve encircling it. These sleeves are cylindrical walls projecting outwardly from jacket 22 in the same direction as the tabs of seams 22D and 22E. These sleeves provide additional protection around the nozzle as will be described in further detailed hereinafter.

In FIG. 5, a detailed perspective view is given of sleeve 22F for aperture 22B. Sleeve 22F is shown as a modified cylinder. In this view sleeve 22F is interrupted so that the aperture 22B has a keyhole shaped opening provided by the lower notch 22G.

Referring to FIGS. 6 and 7, previously mentioned jacket 20 is shown with an aperture 20B encircling nozzle N. Inserted through aperture 20B is a cloven stub 24 which is shown in further detail FIG. 7. As shown in FIG. 7, nozzle N has extending from it threaded coupling NC. Depending downwardly from nozzle N is eye E, having a hole through which a chain (not shown in this figure) may be secured. Stub 24 is essentially a solid of a revolution, but is interrupted to allow a clearance for eye E. Stub 24 has an inner cylindrical wall integrally joined to an annular flange. As shown in FIG. 6, stub 24 effectively extends jacket 20 into a cylindrical wall protecting nozzle N.

Referring again to FIG. 6, nozzle cap NT is shown threaded onto nozzle coupling NC. Nozzle cap NT is shown with a removal nut NR. Cap 30 is shown with a central hole through which removing nut NR protrudes. Cap 30 has a shape generally conforming to nozzle cap NT. Cap 30 has inserted at its brim annulus 32, which is a device having an "L" shaped cross section. Annulus 32 may be riveted, glued or otherwise secured to the brim of cap 30. Once secured, cap 30 is locked onto nozzle cap NT.

Figure 8:
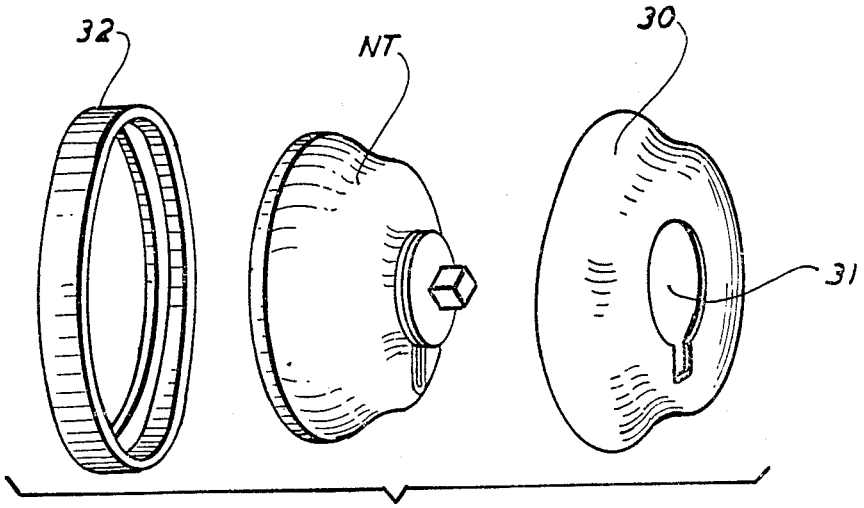
FIG. 8 is an exploded, perspective view of the nozzle cap and its covering of FIG. 6.

Referring to FIG. 8, an exploded view is given showing how cap 30 and annulus 32 encompass nozzle cap NT. Also, central aperture 31 of cap 30 is keyhole-shaped to allow clearance for the chain linkage previously illustrated in FIG. 6.

Figure 9:
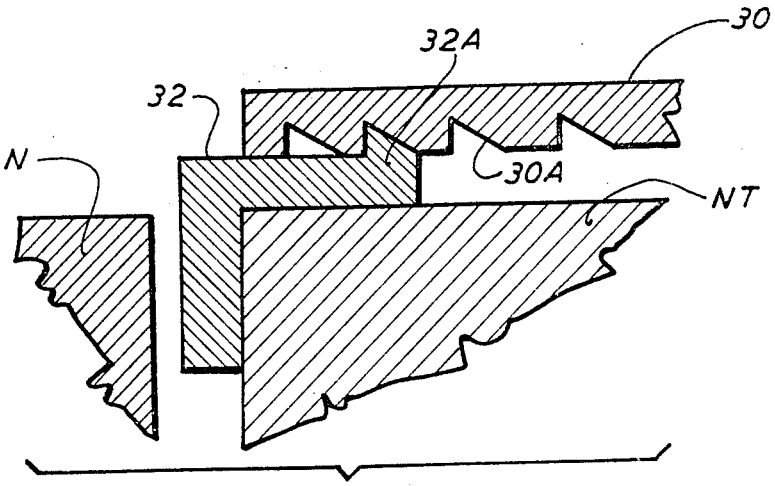
FIG. 9 is a detailed cross sectional view of the joint between the cap and the clip of FIG. 6, but modified to show a barb-and-groove locking arrangement.

Referring to FIG. 9, a detail is given of the intersection of the annulus 32 with the nozzle N and nozzle cap NT. In this embodiment, annulus 32 is showing having a barb 32A. Barb 32A is shown with a projection having a triangular cross section. Triangular depressions 30A are shown in cap 30. These depressions 30A are annular grooves that are concentrically placed on the inside of cap 30 and are spaced axially. Accordingly, annulus 32 can be positioned as shown on the brim of caps 30 and NT. Thereafter, plastic cap 30 can be pushed downwardly onto cap NT with annulus 32 held against cap NT. Consequently, barb 32A will be ratcheted into successively deeper depressions 32A, thereby locking cap 30 securely to cap NT.

It will be appreciated that various modifications may be implemented with respect to the above described preferred embodiments. In particular, the cover may be formed of various materials, especially plastics. The plastics can be, for example; colored red or green or with appropriate color coding indicating the pressure and volume associated with a particular hydrant. In some embodiments, the cover will be impregnated with florescent pigment. This will enable the hydrant to be visible at great distances. This feature is especially significant for emergency situation, when a hydrant must be quickly located. Additionally, the various curves and shapes associated with the hydrant cover can be altered depending upon the particular hydrant targeted. It is desirable to have the cover closely conforming to the bonnet and barrel of the hydrant. In some embodiments, however, the cover will be shaped so that it fits loosely and thereby becomes compatible with various other types of hydrants. Similarly, the jacket covering the barrel of the hydrant can have openings dictated by the number of nozzles on the hydrant being covered. It will also be appreciated that the thickness of the cover can vary depending upon the desired durability, strength and by the requirement that the cover be removable when servicing is necessary. Accordingly, the various dimensions of the cover can be varied to suit the particular hydrant and application.

Obviously, many modifications and variations of the present invention are possible in the light of the above teachings. It therefore to be understood that with the scope of the appended claims, the invention may be practiced otherwise than as specifically described.

What is claimed is:

1. A cover for a hydrant having a bonnet mounted atop an upper barrel having two flanged ends, comprising:

a domed, annular hood shaped to correspond to said bonnet; and an externally convex skirt depending from said annular hood, said convex skirt being sized to overlay and underlie one of the flanged ends of said upper barrel to encase it, said skirt including means depending from said hood for engaging a portion of said bonnet and said depending means embracing and maintaining said hood over and under at least on of said flanged ends.

2. A cover according to claim 1 wherein said externally convex skirt comprises:

an outward annular projection integrally supported from said annular hood and having an L-shaped cross-section; and an annular clip sized to fit within said outward annular projection.

3. A cover according to claim 2 wherein said annular clip is split and comprises:

a pair of complementary arches each including a semi-cylindrical wall integral with a planer base having two opposing concentric borders.

4. A cover according to claim 1 further comprising:

a tubular jacket having an axial seam and positioned to meet said convex skirt from below, said jacket being sized to encompass said upper barrel.

5. A cover according to claim 4 wherein said upper barrel has at least one capped nozzle and wherein said jacket has at least one aperture adapted to be aligned with said nozzle.

6. A cover according to claim 5 wherein said aperture in said jacket is keyhole-shaped.

7. A cover according to claim 6 further comprising:

a flanged tubular stub sized for insertion into said aperture.

8. A cover according to claim 7 wherein said stub is cloven.

9. A cover according to claim 5 wherein said jacket comprises:

a sleeve bordering said aperture.

10. A cover according to claim 5 wherein said seam in said jacket includes a pair of outwardly projecting tabs fastened together.

11. A cover according to claim 5 further comprising:

a tubular boot encircling said barrel between one of its flanged ends and said jacket.

12. A cover according to claim 11 wherein the end of said boot distal from said jacket is flared to cover one of the flanged ends of said barrel.

13. A cover according to claim 12 wherein said boot comprises a pair of complementary half-shells. with the scope of the appended claims, the invention may be practiced otherwise than as specifically described.

14. A cover according to claim 5 further comprising:

a cap shaped to cover said capped nozzle.

15. A cover according to claim 14 wherein said cap has a brim that projects inwardly to embrace said capped nozzle.

16. A cover according to claim 14 wherein said cap has a central hole.

17. A cover according to claim 16 wherein said central hole is keyhole-shaped.

18. A cover according to claim 14 further comprising:

an annulus inserted into and behind said cap and having a cylindrical partition and an inwardly projecting, annular shelf.

19. A cover according to claim 18 wherein said cylindrical partition has an external barb and wherein said cap has a plurality of axially spaced, ratcheting depressions sized to receive said barb and secure said annulus to said cap.

* * * * *